US007452239B2

(12) United States Patent
Montena

(10) Patent No.: US 7,452,239 B2
(45) Date of Patent: Nov. 18, 2008

(54) COAX CABLE PORT LOCKING TERMINATOR DEVICE

(75) Inventor: Noah Montena, Syracuse, NY (US)

(73) Assignee: John Mezzalingua Associates Inc., East Syracuse, NY (US)

( * ) Notice: Subject to any disclaimer, the term of this patent is extended or adjusted under 35 U.S.C. 154(b) by 0 days.

(21) Appl. No.: 11/553,173

(22) Filed: Oct. 26, 2006

(65) Prior Publication Data

US 2008/0102704 A1 May 1, 2008

(51) Int. Cl.
*H01R 13/44* (2006.01)

(52) U.S. Cl. ..... 439/620.03; 439/133

(58) Field of Classification Search ..... 439/620.03, 439/133, 307, 578
See application file for complete search history.

(56) References Cited

U.S. PATENT DOCUMENTS

| | | | | |
|---|---|---|---|---|
| 4,500,746 | A | 2/1985 | Meehan | |
| 4,586,769 | A | 5/1986 | Tengler et al. | |
| 4,722,022 | A | 1/1988 | Myers et al. | |
| 4,810,211 | A | 3/1989 | Hutnak et al. | |
| 4,838,813 | A | 6/1989 | Pauza et al. | |
| 4,932,873 | A | 6/1990 | La Shier | |
| 4,954,089 | A | 9/1990 | Jensen et al. | |
| 5,055,060 | A * | 10/1991 | Down et al. | 439/304 |
| 5,387,131 | A | 2/1995 | Foreman et al. | |
| 5,904,596 | A | 5/1999 | Knaus et al. | |
| 5,967,802 | A | 10/1999 | Daly et al. | |
| 6,109,970 | A | 8/2000 | Lim | |
| 6,132,239 | A | 10/2000 | Naerland | |
| 6,210,200 | B1 | 4/2001 | Kranzdorf | |
| 6,247,971 | B1 | 6/2001 | Lim | |
| 6,491,546 | B1 * | 12/2002 | Perry | 439/620.03 |
| 6,963,690 | B1 | 11/2005 | Kassal et al. | |
| 7,086,877 | B1 * | 8/2006 | Abbott | 439/133 |
| 7,320,611 | B2 * | 1/2008 | Abbott | 439/133 |
| 2004/0219838 | A1 | 11/2004 | Kooiman | |
| 2005/0026504 | A1 | 2/2005 | Nishimura | |
| 2005/0208833 | A1 * | 9/2005 | Oksengorn | 439/620 |
| 2006/0073726 | A1 | 4/2006 | Montena | |
| 2006/0089027 | A1 | 4/2006 | Chawgo et al. | |

FOREIGN PATENT DOCUMENTS

| | | |
|---|---|---|
| EP | 0 997 979 B1 | 2/2004 |

* cited by examiner

*Primary Examiner*—Gary F. Paumen
(74) *Attorney, Agent, or Firm*—Hiscock & Barclay, LLP

(57) ABSTRACT

A locking terminator device for a coax cable port is used for preventing ingress of electrical signals into the port and also to prevent theft of cable signals by non-subscribers. The device of the present invention includes an outer terminator housing, an inner connector housing having two slots for receiving the tabbed tool feet of a specialized tool, and a terminator having a resistor post, a cylindrical body, and a conical end. The device provides for a tamper-resistant terminator by having a specialized tool with two tabbed feet that are spread outwardly when pressed against the conical end of the terminator to engage the slots of the inner connector body. Once the slots are engaged the tool can be used to lock or unlock the locking terminator device to a cable port of a tap assembly.

12 Claims, 5 Drawing Sheets

COAX CABLE PORT LOCKING TERMINATOR DEVICE

FIELD OF THE INVENTION

This invention relates a device in the coaxial cable industry for locking unused ports to prevent theft of cable services and ingress of electrical signals into the port.

BACKGROUND OF THE INVENTION

Cable systems are generally organized so that there is central cable line connected to a tap assembly. The tap assembly has an outer housing and several ports for use in distributing signals to the individual subscribers via a drop line that connects the cable signal from the tap to the subscriber's home. The use of these tap assemblies assists in providing multiple signals to multiple subscribers in the same geographic region. However, the tap assemblies generally have more ports than subscribers, thereby leaving some ports unused and open.

Since some cable ports may remain unused, it is desirable to terminate the open, unused port. Termination of a port is desired for a few reasons. First, when a port remains open it can affect the quality of the signal being transmitted to the other subscribers. Second, the termination of a port is desired to eliminate spurious electrical signals from entering open, unused port. Another and often more important reason to close a port is for prevention of unauthorized use of cable signals by those who do not subscribe to a cable service (i.e. cable theft). Further, the termination of a port can assist in suspending service of a subscriber by using a device placed between the cable port and the drop line used to provide service to the individual subscriber. Because cable theft is a growing concern within the cable service industry, and the level of sophistication by those who participate in such activities, it is desired to have a termination device that provides all the above benefits and is resistant to tampering for purposes of cable theft.

Due to the desire in the industry of tamper-resistant devices to prevent or deter cable theft, there are devices in the industry used to lock cable ports. Prior art devices have been used to accomplish the needs of terminating a signal and locking a port. However, such devices do not have ease of use in locking and unlocking ports, and further are not always successful in preventing theft of cable signals. For instance, FIG. 1 shows a conventional terminator device for locking a coax cable port. The device, however, is susceptible to tampering because it can be "picked" with household tools such as screwdrivers or drills. Further, the device requires the use of a specialized tool, however, the tool is not easily used with the device for unlocking and locking. Specifically, the prior art device requires manual actuation of the tool by pressing the tool against the terminator device to extend the tool feet out of the tool housing to engage the terminator device for locking and unlocking. An example of such a termination device shown in FIG. 1 is described in U.S. Pat. No. 6,491,546 (Perry), the disclosure of which is herein incorporated by reference.

Accordingly, a locking termination device is desired that can simultaneously close and lock a cable port so that it is tamper-resistant for purposes of preventing cable theft. Further, the locking termination device needed in the industry is one where the device may be easily locked and unlocked by cable service professionals charged with providing, suspending, or ending cable signals to given subscribers.

SUMMARY OF THE INVENTION

The invention comprises, in one form thereof, a device for mounting on a coax cable port for locking the port comprising an outer terminator housing, an inner connector body opposing slots for engagement of a specialized tool, and a means for tamper-proof locking of the device and termination of the cable signal.

More particularly, the invention includes a locking terminator comprising an outer terminator housing, and an inner connector body having slots for engaging a specialized tool used to lock and unlock the invention, and a terminator having a cylindrical body, a conical end, and a resistor.

In another form, the invention includes a method for making a locking terminator device. The method comprises the steps of providing an outer terminator housing, an inner connector body having two opposing slots, and a terminator having a resistor, a cylindrical body, and a conical end, inserting the terminator into the inner connector body, and then inserting the inner connector body into the outer terminator housing.

An advantage of the present invention is that the device is not susceptible to "picking" by those trying to engage in cable theft because of the conical end which makes it difficult to drill. Further the conical end of the terminator is made of a hardened steel material which protects it from drilling through to the coax cable port.

A further advantage of the present invention is that the conical end provides automatic actuation of the specialized tool because the conical end serves to spread the tool feet which then engage the slots of the inner connector body and can then be used to lock and unlock the termination device.

BRIEF DESCRIPTION OF THE DRAWINGS

The present invention is disclosed with reference to the accompanying drawings, wherein.

Corresponding reference characters indicate corresponding parts throughout the several views. The example set out herein illustrates one embodiment of the invention but should not be construed as limiting the scope of the invention in any manner.

DETAILED DESCRIPTION

Figure 1:
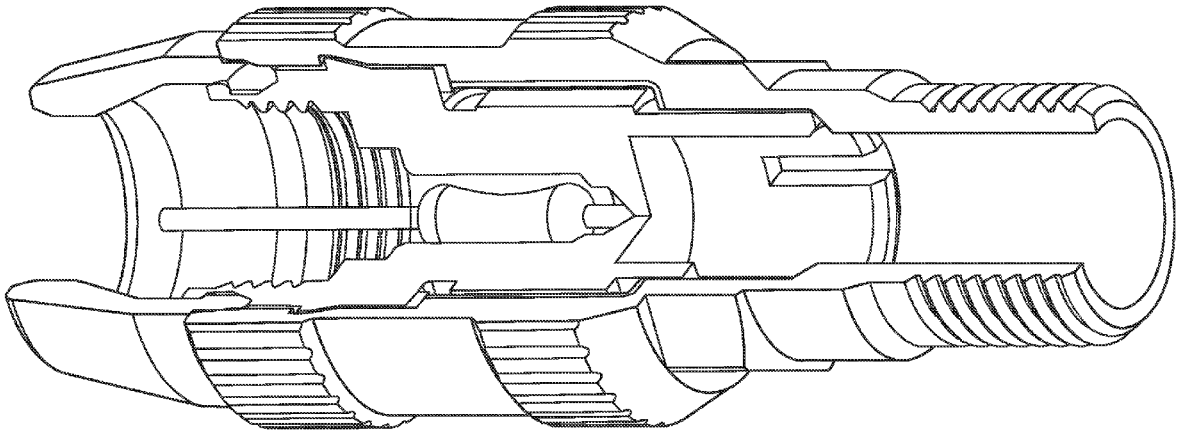
Prior Art Fig. 1
FIG. 1 is a cut-out view of a conventional locking termination device according to the prior art.
Figure 2:
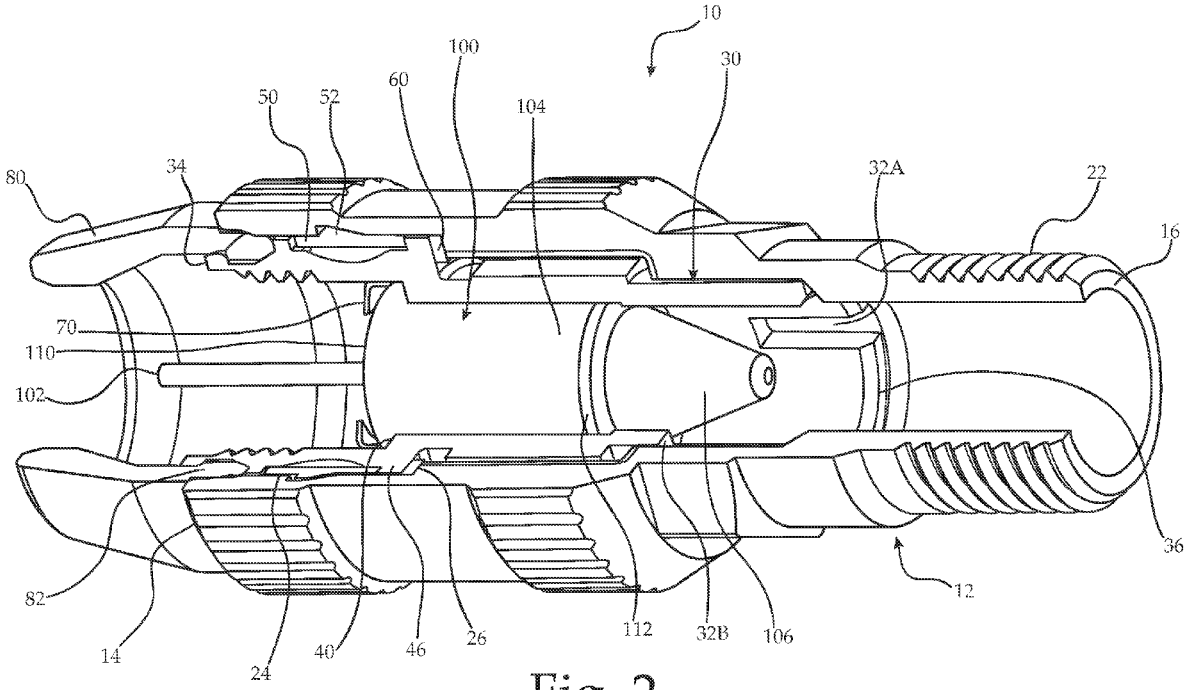
FIG. 2 is a cut-out view of the locking termination device of the present invention.
Figure 3:
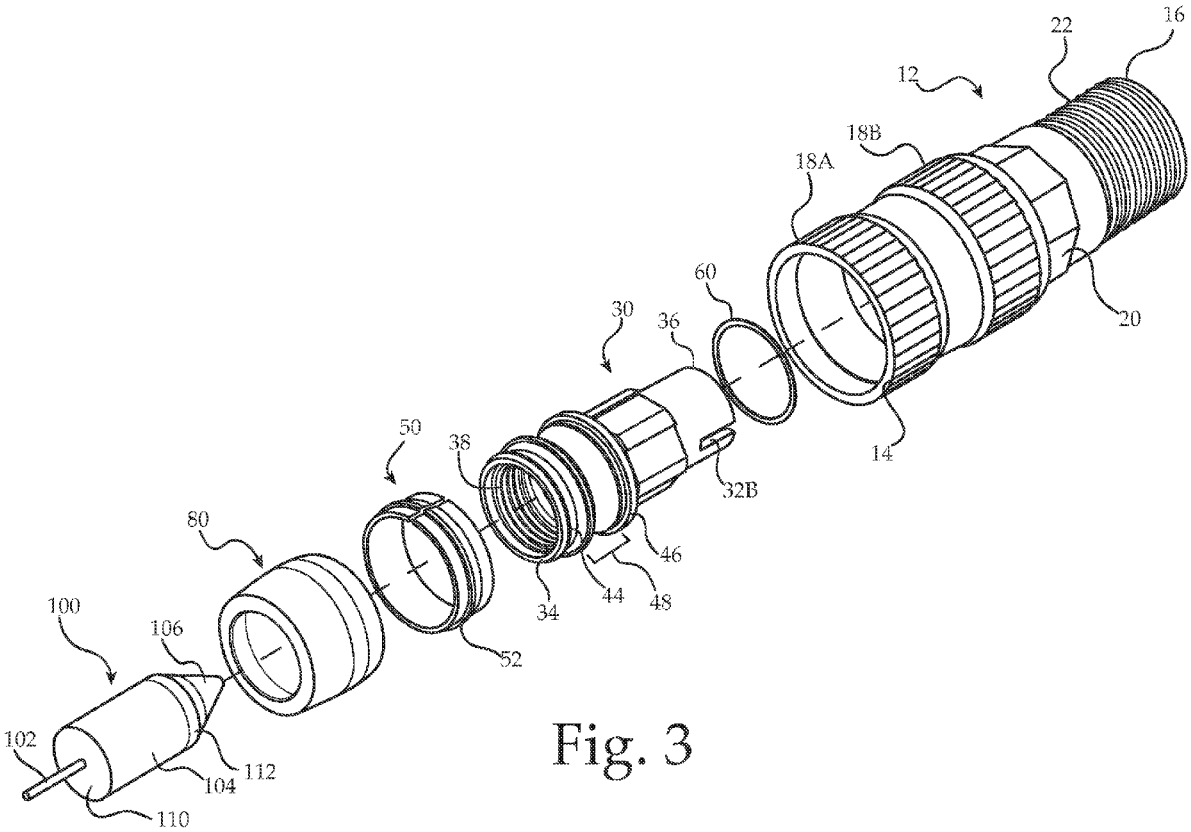
FIG. 3 is an exploded view of the locking termination device of the present invention.

The locking terminator device 10 of the present invention is shown in FIGS. 2 and 3. The locking terminator device 10 includes an outer terminator housing 12, an inner connector body 30, and a coaxial cable signal terminator 100. The outer terminator housing 12 is a unitary piece fully containing the connector body 30 and terminator 100. The outer terminator housing 12 has a first end 14 and a second end 16. The diameter of the outer terminator housing 12 both interiorly and exteriorly decreases as viewed from the first end 14 to the second end 16. The exterior of the outer terminator housing 12 has two raised gripping portions 18*a*, 18*b* useful for attaching, for instance, a drop line to the second end 16 of the outer terminator housing 12 of the locking terminator device 10. Below the gripping portions 18*a*, 18*b* is a nut portion 20 of the outer terminator housing 12. The nut portion 20 is slightly less in diameter than the gripping portions 18*a*, 18*b*. The second end 16 of the outer terminator housing 12 has an external threaded portion 22 for connecting the locking terminator device 10 to a drop line. For instance, if a locking terminator device is used only to suspend service to a customer for a limited time, the drop line can be attached to the outer terminator housing 12 as described above. Thus, when the suspended cable service is reinstated, the drop cable line is readily available for connection.

Still referring to FIGS. 2-3, the interior side of the outer terminator housing 12 is substantially circular, but is, again, of varying geometries and contains recess for housing coupling elements to secure the inner connector body 30 with the outer terminator housing 12. Specifically, the outer terminator housing 12 has a recess 24 for receiving a barb or ridge element under the gripping portion 18*a*. A snap bearing 50 has a ridge 52 that fits within the recess 24 of the outer terminator housing 12. Disposed around the inner connector body 30 is a snap bearing 50, which allows the outer terminator housing 12 rotate relative to the inner connector body 30.

As previously mentioned, the inner geometry of the outer terminator housing 12 slightly decreases in diameter from the first end 14 to the second end 16. In the inner area of the outer terminator housing 12, between the first gripping portion 18*a* and the second gripping portion 18*b*, there is a lip 26 against which a coupling element 60, such as an O-ring, is placed so that there is, again, a secure connection between the outer terminator housing 12 and the inner connector body 30. The inner surface of the outer terminator housing 12 continues to decrease in diameter moving toward the second end 16 of the outer terminator housing 12. The interior area of the second end 16, more specifically, the inner portion related to the external threaded portion 22 of the outer termination housing 12 is substantially cylindrical. The diameter of the entire outer terminator housing 12 is at its smallest in size at the second end 16, but is at least large enough so as to allow entry of the specialized tool 200 (shown in FIGS. 4-5). In other words, the diameter of the second end 16 of the outer terminator housing 12 is greater than the diameter of the specialized tool 200 (shown in FIG. 5) used to lock or unlock the locking terminator device 10.

Referring still to FIGS. 2-3, the inner connector body 30 has a first end 34 and a second end 36. The first end 34 has a circular opening and an internal threaded portion 38 for connection, for instance, to a cable port of a tap assembly (not shown). The inner connector body 30 has two decreases in the diameter, the first decrease in diameter occurs after the internal threaded portion 38 of the inner connector body 30. The first indentation 40 of the inner connector body 30 creates a secure fit between the terminator body 104 of the terminator 100 and the central portion of the inner connector body 30. In a corresponding area on the external side of the inner connector body 30, there is a outer protrusion 46 that interlocks the inner connector body 30 with the outer terminator housing 12. The outer protrusion 46 rests against the coupling element 60, which is compressed between the inner connector body 30 and the lip 26 of the outer terminator housing 12.

The second decrease in diameter occurs at the second end 36 of the inner connector body 30. The decrease in diameter is characterized by a second indentation 42 in the inner connector body 30. This second indentation 42 serves as a shelf against which a second end 112 of the terminator body 104 rests.

Figure 4:
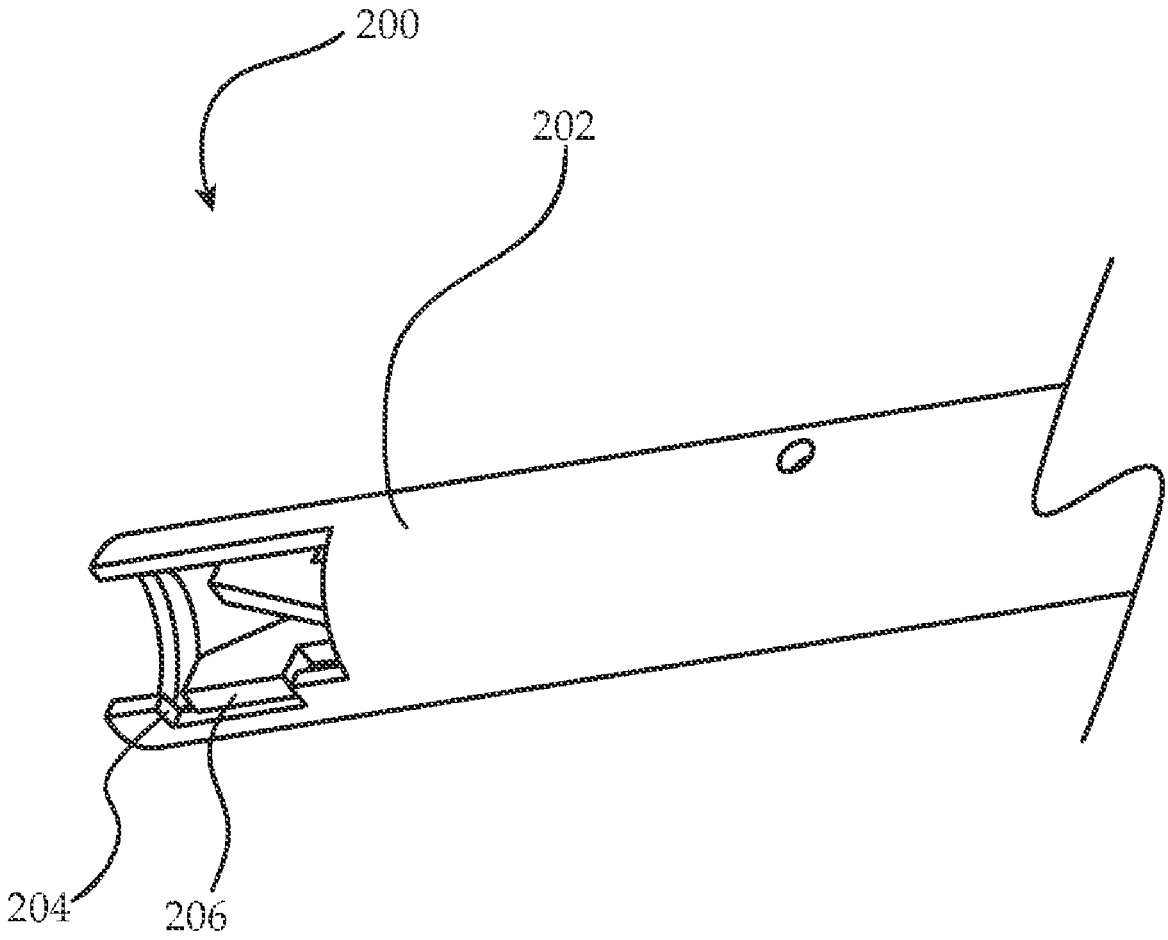
FIG. 4 is an cut-out view of the specialized tool used for locking and unlocking the locking termination device of the present invention.
Figure 5:
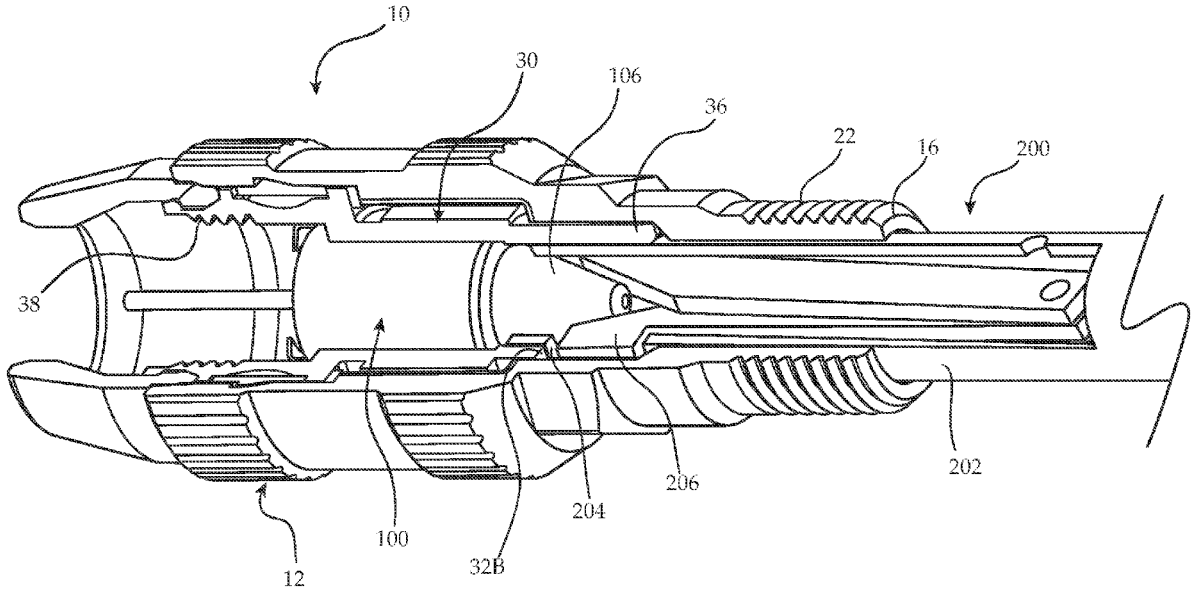
FIG. 5 is a cut-out view of the locking termination device engaged by a specialized tool.

The second end 36 of the inner connector body 30, importantly, contains two slots 32*a*, 32*b* into which tool feet of a specialized tool (as shown in FIG. 4) for engaging and disengaging the locking terminator device 10 fit. The slots 32*a*, 32*b* are on opposite sides because the tool 200 that is used to lock and unlock the locking terminator device 10 has two tool feet 206 that spread out as they come into contact with a conical end 106 of the terminator 100 itself (as shown in FIG. 5). The second end 36 would therefore have a diameter large enough to fit the specialized tool 200 (not shown).

The external side of the inner connector body 30 too follows the same change in geometries as the interior side of the inner connector body 30 so that the diameter of the inner connector body 30 decreases from the first end 34 to the second end 36. The external side of the first end 34 of the inner connector body 30 has a recess 44 for receiving a connector cap 80 for attachment of the locking terminator device 10, for instance, to a cable port on a tap assembly. The connector cap 80 has a flange 82 to fit in the recess 44 of the inner connector body 30. The connector cap 80 is coupled to the locking terminator device 10 between the inner connector body 30 and the outer terminator housing 12. The inner connector body 30 also has a bearing retainer 48 for housing the snap bearing 50, and the ridge 52 of the snap bearing 50. All of the elements fit together allowing the outer terminator housing to rotate about the inner connector.

Still referring to FIGS. 2-3, before the first decrease in diameter of the inner connector body 30, the external surface of the inner connector body 30 has a protrusion 46 which serves two purposes. First, the protrusion 46 acts as a second wall for creating a housing for the snap bearing 50. Second, the protrusion 46 doubles as an edge against which the lip 26 of the outer terminator housing 12 can press up against, noting that there is a coupling element 60, such as an O-ring, between the lip 26 and the protrusion 46. The structure of the external surface of the inner connector body 30 and the internal surface of the outer terminator housing 12 serve to compliment each other, whereby each decrease in diameter in the outer terminator housing 12 is matched with a corresponding element on the external surface of the inner connector body 30 for coupling the inner connector body 30 with the outer terminator housing 12. The complimentary system is created so that there is a secure and tight connection between the two pieces to provide for an effective locking terminator device that is not susceptible to tampering, while still allowing the two pieces to rotate freely about each other to engage different parts (e.g. a cable port and drop line).

The cable terminator device 100 essentially has three main parts: a resistor post 102, a terminator body 104, and a conical end 106. The resistor post 102 of the terminator 100 sits centrally in the opening of the first end 34 of the inner connector body 30. The resistor post 102 connects the locking terminator device 10, for instance with a cable port on a tap assembly (not shown). The terminator body 104 houses the post portion 102 and is a cylindrical body. From the second end 112 of the terminator body 104 there is a conical end 106 to the terminator device 100.

The conical end 106 is on the second end 112 of the terminator body 104 and is positioned in the center so that there is an edge that can rest against the second indentation 42 of the inner connector body 30. The conical portion 106 can be made of a hardened steel material so that it is difficult to drill through, thereby serving as a deterrent or hindrance to cable theft. Further, the cone shape creates a difficult target in which to drill or pick, and too serves the purpose of creating a tamper-resistant locking terminator device. The second end 112 of the terminator body 104 and the second indentation 42 of the inner connector body 30 act to hold the terminator 100 in the inner connector body 30 for secure connection. Moving back to the first end 110 of the terminator body 104, there is a retaining element 70. The retaining element 70 is coupled to the first end 110 of the terminator body 104 to hold the terminator 100 to the inner connector body 30 and may also serve to provide a tight connection between a cable port and the locking terminator device 10. The tight connection is necessary to prevent the ingress of spurious electrical signals or other environmental factors that can affect the quality of the signal provided to other subscribers receiving a signal from a single tap assembly.

Referring to FIG. 4, the locking terminator device 10 requires the use of a specialized tool 200 to engage and disengage the locking terminator device 10 to a cable port (not shown). The tool 200 has an outer cylindrical housing 202 which has openings 204 on opposing sides of the housing 202 for exposing the tool feet 206 contained in the housing 202. The tool feet 206 are attached so that they can pivot outwardly, when in contact with the conical end 106 of the terminator 100. The housing 202 has an opening in which the conical portion 106 of the terminator 100 would enter to spread the tool feet 206.

Referring to FIG. 5, there is an exemplar of the tool 200 entering the second end 16 of the outer terminator housing 12 and the second end 36 of inner connector body 30. The conical portion 106 of the terminator 100 forces the tool feet 206 to spread outwardly through the openings 204 of the tool housing 202 and into the slots 32*a*, 32*b* of the inner connector body 30. Once the tool feet 206 are in slots 32*a* (not visible), 32*b*, the tool 200 is engaged with the locking terminator device 10 and can advance the locking terminator device 10 onto a cable port of a tap assembly via the internal threaded portion 38 of the inner connector body 30. Once the locking terminator device 10 is locked to the cable port, the tool is pulled out, thereby closing and locking the cable port. Again, if desired a drop line could be attached to the external threaded portion 22 of the outer terminator housing 12.

The locking terminator device of the present invention has improvements over previous devices that are used for similar purposes. First, the device requires the use of a specialized tool, not available to the general public, to lock and unlock the terminator device, thereby preventing easy removal of the locking terminator device. The locking termination device has an advantage over the prior art in that there is automatic engagement of the specialized tool by the cone spreading the tool feet to enter the slots of the inner connector so that it can be used to lock and unlock the terminator. Further, the use of a cone creates a difficult surface to drill through, and may also be made of a material, such as hardened steel, such that it cannot or at least easily be drilled through. This is an improvement over the prior art, as previous terminator devices were easily removed or picked by common tools such as screwdrivers and drills.

While the invention has been described with reference to a particular embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiment disclosed as the best mode contemplated for carrying out this invention, but that the invention will include all embodiments falling within the scope and spirit of the appended claims.

PARTS LIST

10 Locking Terminator Device
12 Outer Terminator Housing
14 First End of Outer Terminator Housing
16 Second End of Outer Terminator Housing
18*a* First Gripping Portion of Outer Terminator Housing
18*b* Second Gripping Portion of Outer Terminator Housing
20 Nut Portion of Outer Terminator Housing
22 External Threaded Portion of Outer Terminator Housing
24 Recess of Outer Terminator Housing
26 Lip of Outer Terminator Housing
30 Inner Connector Body
32*a* First Slot for Tool Engagement of Inner Connector Body
32*b* Second Slot for Tool Engagement of Inner Connector Body
34 First End of Inner Connector Body
36 Second End of Inner Connector Body
38 Internal Threaded Portion of Inner Connector Body
40 First Indentation of Inner Connector Body
42 Second Indentation of Inner Connector Body
44 Recess of Inner Connector Body
46 Outer Protrusion of Inner Connector Body
48 Bearing Retainer of Inner Connector Body
50 Snap Bearing of Inner Connector Body
52 Ridge of Snap Bearing
60 Coupling Element
70 Retaining Element
80 Connector Cap
82 Connector Cap of Flange
100 Coaxial Cable Signal Terminator (Terminator)
102 Resistor Post of Terminator
104 Terminator Body of Terminator
106 Conical End of Terminator
110 First End of Terminator Body
112 Second End of Terminator Body
200 Tool
202 Outer Cylindrical Housing of Tool (Housing)
204 Openings for Tool Feet
206 Tool Feet

The invention claimed is:

1. A locking terminator for a coax cable port comprising:
an outer terminator housing;
an inner connector body having at least one slot for receiving tool feet of a specialized tool; and
a terminator having a cylindrical body, a conical end, and a resistor;
wherein the conical end directly engages a locking means.

2. The locking terminator device of claim 1 wherein the locking means comprises a tool comprising a tubular housing and pivotly attached tool feet having at least one tabbed end housed within the tubular body.

3. The locking terminator device of claim 2 wherein the tool foot moves laterally when in contact with the conical end of the terminator such that the tabbed end engage the slot of the inner connector body.

4. The locking terminator device of claim 2 wherein the tool foot is used to lock and unlock the device by engaging the tabbed end of the tool foot with the slot of the inner connector body.

5. The locking terminator of claim 1:

wherein the inner connector body comprises a first end and a second end;

wherein the inner connector body is threaded on the inside of the first end; and wherein the inner connector body has varying inner and outer geometries decreasing from the first end to the second end of the inner connector body.

6. The locking terminator of claim 1:

wherein the outer terminator housing has a first end and a second end;

wherein the outer terminator housing is threaded on the outside of the second end; and wherein the outer terminator housing has varying inner and outer geometries decreasing from the first end to the second end of the outer terminator housing.

7. The device of claim 1, wherein the conical end of the terminator is made from a hardened steel material.

8. A device for mounting on a coax cable port for locking the port comprising:

an outer terminator housing;

an inner connector body having at least one slot; and means for tamper-proof locking the device to a coax cable port;

wherein the means for tamper-proof locking comprises a terminator comprising a resistor, a cylindrical body, and a conical end, and a tool with at least one tabbed end for engagement of the slot of the inner connector body wherein the conical end directly engages the tool.

9. A method of making a locking terminator device comprising:

providing a outer terminator housing having a first end and a second end, an inner connector body having a first end and a second end wherein the second end has two opposing slots, an external connector body, and a terminator comprising a resistor, a cylindrical body, and a conical end wherein the conical end must directly engage a locking means for the terminator device;

inserting the terminator to the inner connector body such that the conical end of the terminator is directed towards the second end of the inner connector body;

attaching the external connector body with the first end of the inner connector body; and inserting the inner connector body with the terminator to the outer terminator housing such That the second end of the inner connector body is directed towards the second end of the outer terminator housing.

10. The locking terminator of claim 9:

wherein the inner connector body is threaded on the inside of the first end;

wherein the inner connector body has varying inner and outer geometries decreasing from the first end to the second end.

11. The locking terminator of claim 9:

wherein the outer terminator housing has a first end and a second end;

wherein the outer terminator housing is threaded on the outside of the second end; and wherein the outer terminator housing has varying inner and outer geometries decreasing from the first end to the second end.

12. A locking terminator for mounting on a coax cable port comprising:

an outer terminator housing comprising a first end and a second end;

wherein the outer terminator housing is threaded on the outside of the second end;

wherein the outer terminator housing has varying inner and outer geometries decreasing from the first end to the second end;

an inner connector body comprising a first and second end;

wherein the second end of the inner connector body comprises two slots;

wherein the inner connector body is threaded on the inside of the first end;

wherein the inner connector body has varying inner and outer geometries decreasing from the first end to the second end; and a terminator having a cylindrical body, a cortical end, and a resistor, wherein the conical end directly engages a locking means for the terminator device.

* * * * *